US012152366B2

(12) United States Patent
Shin et al.

(10) Patent No.: US 12,152,366 B2
(45) Date of Patent: Nov. 26, 2024

(54) CONSTRUCTION EQUIPMENT

(71) Applicant: Volvo Construction Equipment AB, Eskilstuna (SE)

(72) Inventors: Hungju Shin, Gyeongsangnam-do (KR); Miok Kim, Busan (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 183 days.

(21) Appl. No.: 17/897,581

(22) Filed: Aug. 29, 2022

(65) Prior Publication Data

US 2023/0069238 A1 Mar. 2, 2023

(30) Foreign Application Priority Data

Aug. 30, 2021 (KR) ..... 10-2021-0114959

(51) Int. Cl.
*E02F 3/43* (2006.01)
*E02F 3/32* (2006.01)
*E02F 3/36* (2006.01)

(52) U.S. Cl.
CPC ..... *E02F 3/437* (2013.01); *E02F 3/32* (2013.01); *E02F 3/3681* (2013.01)

(58) Field of Classification Search
CPC . E02F 3/437; E02F 3/32; E02F 3/3681; E02F 3/432; E02F 9/2025; E02F 9/264
See application file for complete search history.

(56) References Cited

U.S. PATENT DOCUMENTS

2020/0232186 A1 7/2020 Nakano et al.
2021/0002853 A1* 1/2021 Yamashita ..... E02F 9/2203

FOREIGN PATENT DOCUMENTS

EP 3748086 A1 12/2020
KR 101582957 B1 1/2016
WO 2020195262 A1 10/2020

OTHER PUBLICATIONS

Translation of WO 2020195262 A1 (Year: 2020).*
Extended European Search Report, Application No. 22191913.7, mailed Feb. 3, 2023, 9 pages.

* cited by examiner

*Primary Examiner* — Shon G Foley
(74) *Attorney, Agent, or Firm* — Sage Patent Group

(57) ABSTRACT

A construction equipment includes a work machine including a boom rotatable with respect to an upper rotating body, a rotatable arm, a rotatable bucket, a tilt rotator including of a tilting actuator, and a rotating actuator; an operation lever for outputting an operation signal corresponding to an operation amount of a driver; a location information providing unit for providing location information and posture information of the work machine; a work setting unit for setting a work area of the work machine, and providing plane information of the work area; and an electronic control unit for controlling the work machine according to a signal inputted from at least one of the operation lever, the work setting unit and the location information providing unit, wherein the electronic control unit controls the posture of the bucket so that the tip of the bucket contacts the work area.

11 Claims, 8 Drawing Sheets

CONSTRUCTION EQUIPMENT

CROSS REFERENCE TO RELATED APPLICATIONS

The present application claims benefit of priority to Korean Patent Application No. 10-2021-0114959, filed Aug. 30, 2021, and is assigned to the same assignee as the present application and is incorporated herein by reference.

TECHNICAL FIELD

The present disclosure relates to a constitution equipment. More specifically, the present disclosure relates to a construction equipment which comprises a tilting actuator for a tilting operation of a bucket and a rotating actuator for a rotating operation of a bucket.

BACKGROUND

An excavator is a construction equipment performing various tasks such as digging for digging up the ground at construction sites, etc., loading for carrying soil, excavating for making a foundation, crushing for dismantling buildings, grading for cleaning the ground, and leveling for leveling the ground.

SUMMARY

An embodiment of the present disclosure provides a construction equipment, comprising a lower traveling body; an upper rotating body rotatably supported on the lower traveling body; a work machine which comprises a boom rotatable with respect to the upper rotating body, an arm rotatable with respect to the boom, a bucket rotatable with respect to the arm, and a tilt rotator including a tilting actuator for supporting the bucket to tilt with respect to the arm, and a rotating actuator for supporting the bucket to rotate with respect to the arm; an operation lever for outputting an operation signal corresponding to an operation amount of a driver; a location information providing unit for providing location information and posture information of the work machine; a work setting unit for setting a work area of the work machine, and providing plane information of the work area; and an electronic control unit for controlling the work machine according to a signal inputted from at least one of the operation lever, the work setting unit and the location information providing unit, wherein the electronic control unit controls the posture of the bucket so that the tip of the bucket contacts the work area.

According to an embodiment, the electronic control unit may calculate a normal vector of the work area in consideration of plane information of the work area.

According to an embodiment, the electronic control unit may specify a target posture of the bucket when the tip of the bucket contacts the work area based on the normal vector and an orthogonal projection of the bucket tip.

According to an embodiment, the electronic control unit may compare a current posture of the bucket with a target posture of the bucket to calculate angular deviation of at least one of a tilting angle, a rotating angle and a rotational angle of the bucket.

According to an embodiment, the electronic control unit may generate a hydraulic pressure corresponding to the angular deviation, and supply the same to at least one of the tilting actuator, the rotating actuator, and a bucket cylinder.

According to an embodiment, the electronic control unit may calculate the displacement between a front end of the arm and the work area when an operation signal of the operation lever is inputted, and control a posture of the bucket when the displacement is smaller than a predetermined reference value.

According to an embodiment, the electronic control unit may control the angular deviation to be reduced as the front end of the arm gets closer to the work area.

According to an embodiment, the electronic control unit may calculate a movement direction vector of the bucket in consideration of the location information and posture information of the work machine provided from the location information providing unit.

According to an embodiment, the movement direction vector of the bucket may be configured to be calculated based on the front end of the arm.

According to an embodiment, the electronic control unit may calculate a width direction vector of the bucket tip by outer products of the movement direction vector of the bucket and the normal vector of the work area.

According to an embodiment, the movement direction vector of the bucket, the normal vector of the work area, and the width direction vector of the bucket tip may be vertical to each other.

According to an embodiment, the location information providing unit comprises at least one of a location measurement unit for measuring location information of the construction equipment, a posture measurement unit for measuring posture information of the construction equipment and posture information of each work machine, and a coordinate calculation unit for calculating coordinates based on the location information and posture information measured from the location measurement unit and the posture measurement unit.

According to an embodiment, the operation lever may generate an electric signal in proportional to the operation amount of the driver as an electric joystick to provide the same to the electronic control device.

According to an embodiment, the electronic control unit may align the rotating axis of the bucket to be vertical to the work area when the rotating operation signal of the bucket lasts longer than a predetermined reference value, control the rotating actuator to correspond to the operation signal to rotate the bucket when the rotating operation signal of the bucket lasts shorter than the predetermined reference value, and control the tilting actuator and the bucket cylinder so that the tip of the bucket cannot invade the work area.

According to an embodiment of the present disclosure, even when the driver does not adjust the tilting or rotating of the bucket arbitrarily, since the tip of the bucket is in contact with the inclined surface while moving, it is possible to remarkably shorten the work time during the excavation work of forming the inclined surface, and provide a uniform inclined surface.

Also, even when the driver does not adjust the rotating angle of the bucket arbitrarily according to the movement direction of the bucket, since the width direction of the bucket tip is controlled to be vertical to the movement direction of the bucket, it is possible to maximize the work area and perform the work more efficiently.

The effects of the present disclosure are not limited to the above-mentioned effects, and it should be understood that the effects of the present disclosure include all effects that could be inferred from the configuration of the disclosure described in the detailed description of the disclosure or the appended claims.

DETAILED DESCRIPTION

Figure 1:
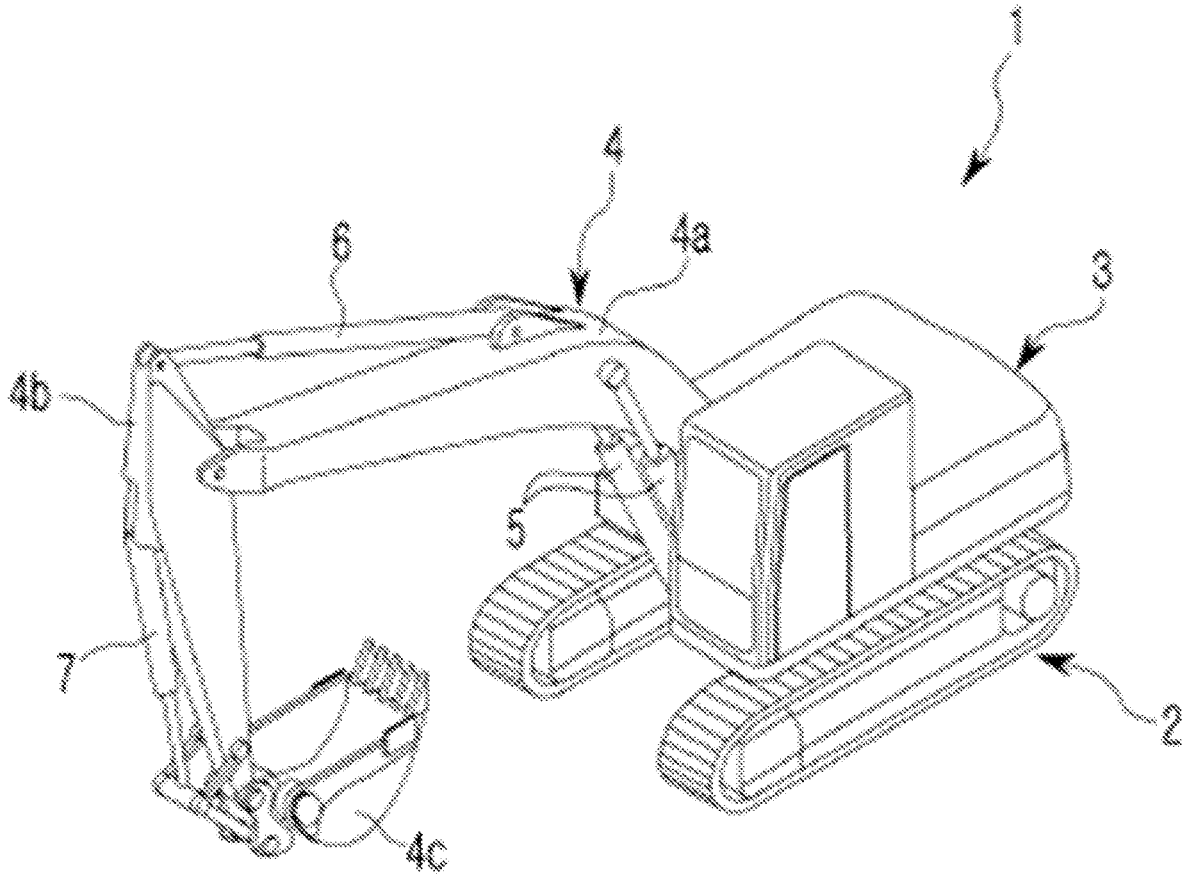
FIG. 1 is a perspective view illustrating a basic configuration of a construction equipment according to the prior art.

The present disclosure is to solve the above-mentioned problem of the prior art. It is an object of the present disclosure to provide a construction equipment capable of providing excellent evenness by automatically controlling a tilting or a rotation of a bucket, so that an excavation work on an inclined surface can be performed more stably.

Hereinafter, the present disclosure will be explained with reference to the accompanying drawings. The present disclosure, however, may be modified in different ways, and should not be construed as limited to the embodiments set forth herein. Also, in order to clearly explain the present disclosure in the drawings, portions that are not related to the present disclosure are omitted, and like reference numerals are used to refer to like elements throughout the specification.

Throughout the specification, it will be understood that when a portion is referred to as being "connected" to another portion, it can be "directly connected to" the other portion, or "indirectly connected to" the other portion having intervening portions present. Also, when a component "includes" an element, unless there is another opposite description thereto, it should be understood that the component does not exclude another element but may further include another element.

The term including an ordinal number like "the first" or "the second" used throughout the specification of the present disclosure may be used to explain various constitutional elements or steps, but the corresponding constitutional elements or steps should not be limited by the ordinal number. The term including the ordinal number should be interpreted only for distinguishing one constitutional element or step from other constitutional elements or steps.

Hereinafter, embodiments of the present disclosure will be explained in detail with reference to the drawings attached.

Referring to FIG. 1, a construction equipment 1 like an excavator comprises a lower traveling body 2, an upper rotating body 3 rotatably installed on the lower traveling body 2, and a work machine 4 installed to vertically operate on the upper rotating body 3.

Additionally, the work machine 4, formed in multi-joints, comprises a boom 4*a* whose rear end is rotatably supported in the upper rotating body 3, an arm 4*b* whose rear end is rotatably supported in the front end of the boom 4*a*, and a bucket 4*c* rotatably installed in the front end of the arm 4*b*. Additionally, hydraulic oil is supplied according to a lever operation of a user, and a boom cylinder (5, work actuator), an arm cylinder (6, work actuator), and a bucket cylinder (7, work actuator) operate the boom 4*a*, the arm 4*b*, and the bucket 4*c*, respectively.

However, the conventional construction equipment 1 as above simply rotates vertically by the boom cylinder 5, the arm cylinder 6, and the bucket cylinder 7 to perform the excavation operation. Accordingly, in case of performing the work in a space where a driving operation or a rotating operation of the construction equipment 1 cannot be easily made, i.e., in a narrow space, the excavation work was made only in one direction, and the excavation direction could not be changed.

Figure 3:
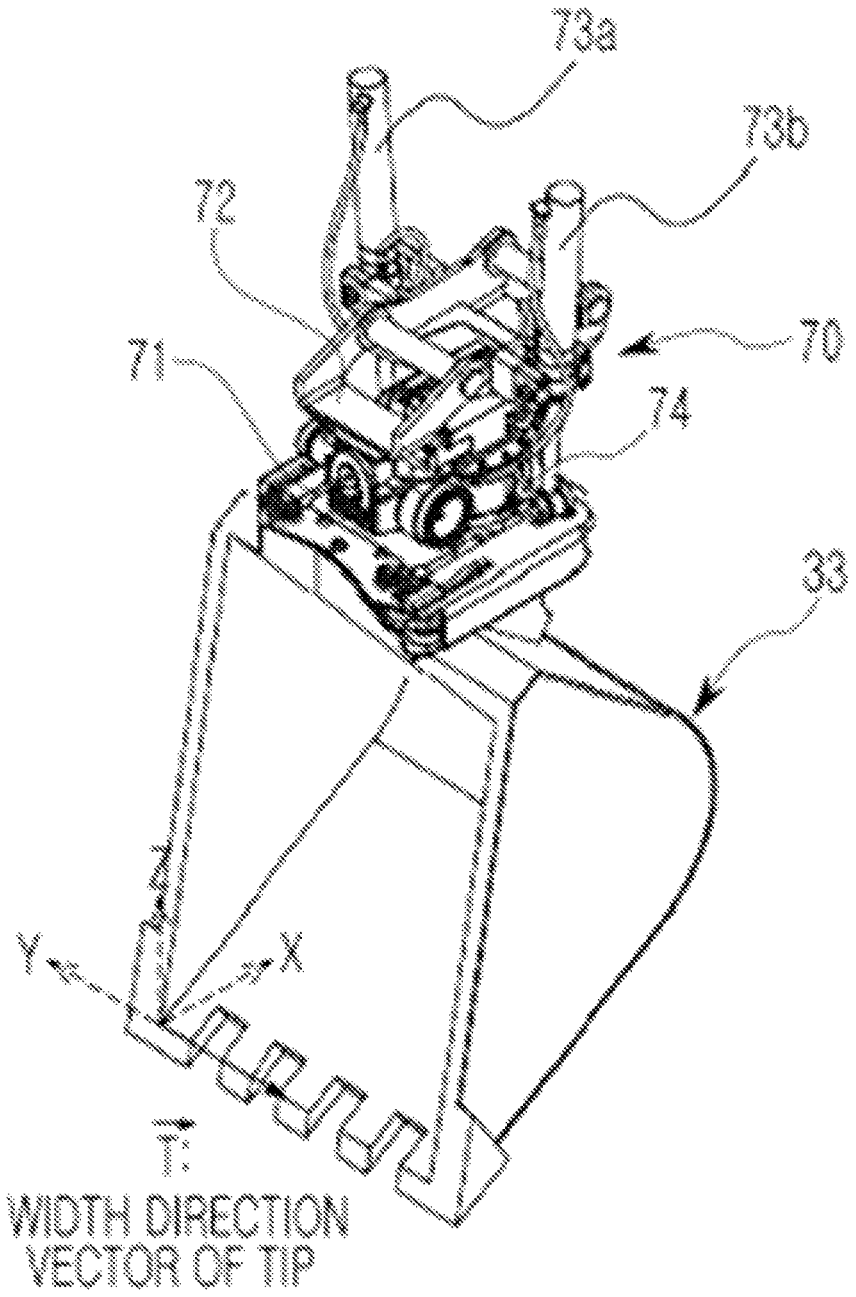
FIG. 3 is a perspective view illustrating a basic configuration of a tilt rotator according to an embodiment of the present disclosure.

In order to solve the above-mentioned problem, a tilt rotator 70 as illustrated in FIG. 3 is suggested.

Specifically, the tilt rotator 70 comprises a rotating actuator 74 for a rotating operation of a bucket 33, and a first tilting cylinder 73*a* and a second tilting cylinder 73*b* as tilting actuators for a tilting operation of the bucket 33. The rotating actuator 74 and the tilting actuator enable the tilting operation and rotating operation of the bucket 33, so that the excavation work can be carried out easily and rapidly without being affected by work space.

Meanwhile, in case of excavating an inclined surface with the bucket 33, it would be more efficient to always have the tip, i.e., end of the bucket 33, in contact with the inclined surface while moving.

However, when moving the bucket 33 along the inclined surface while rotating an upper frame 3 during the excavation, since the angle of the bucket 33 with respect to the inclined surface changes continuously, the driver has to adjust the tilting or rotating of the bucket 33 arbitrarily relying on his senses, which requires higher experienced skills. Therefore, beginners tend to make the inclined surface uneven and cause errors frequently.

Figure 2:
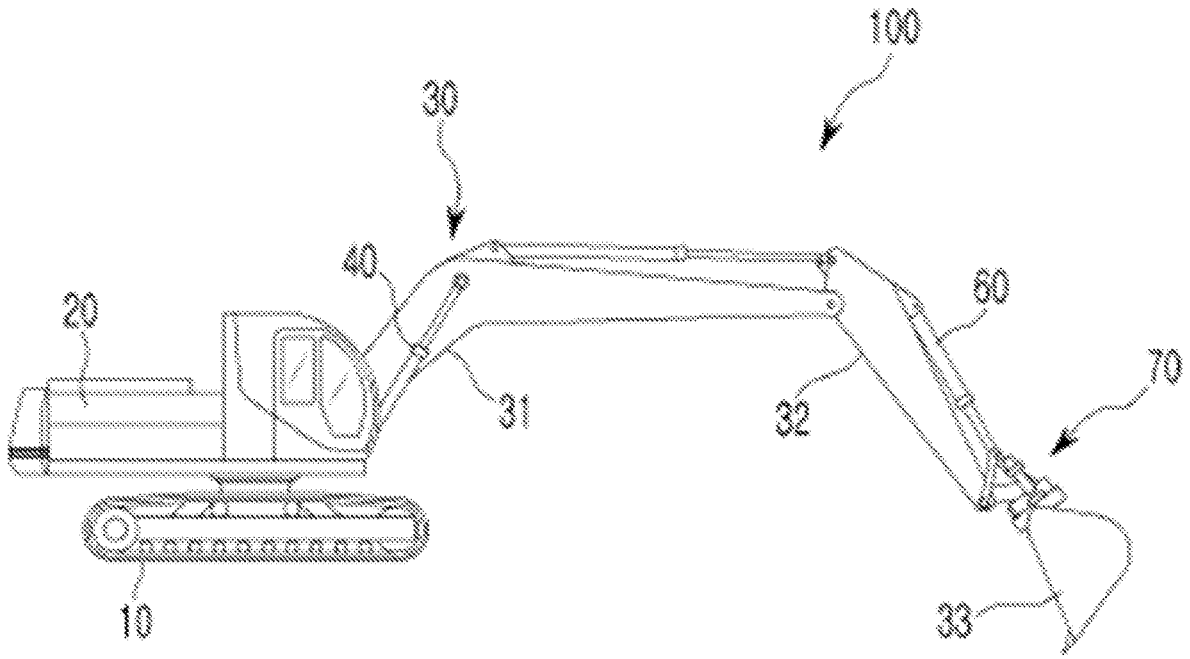
FIG. 2 is a perspective view illustrating a basic configuration of a construction equipment according to an embodiment of the present disclosure.
Figure 4:
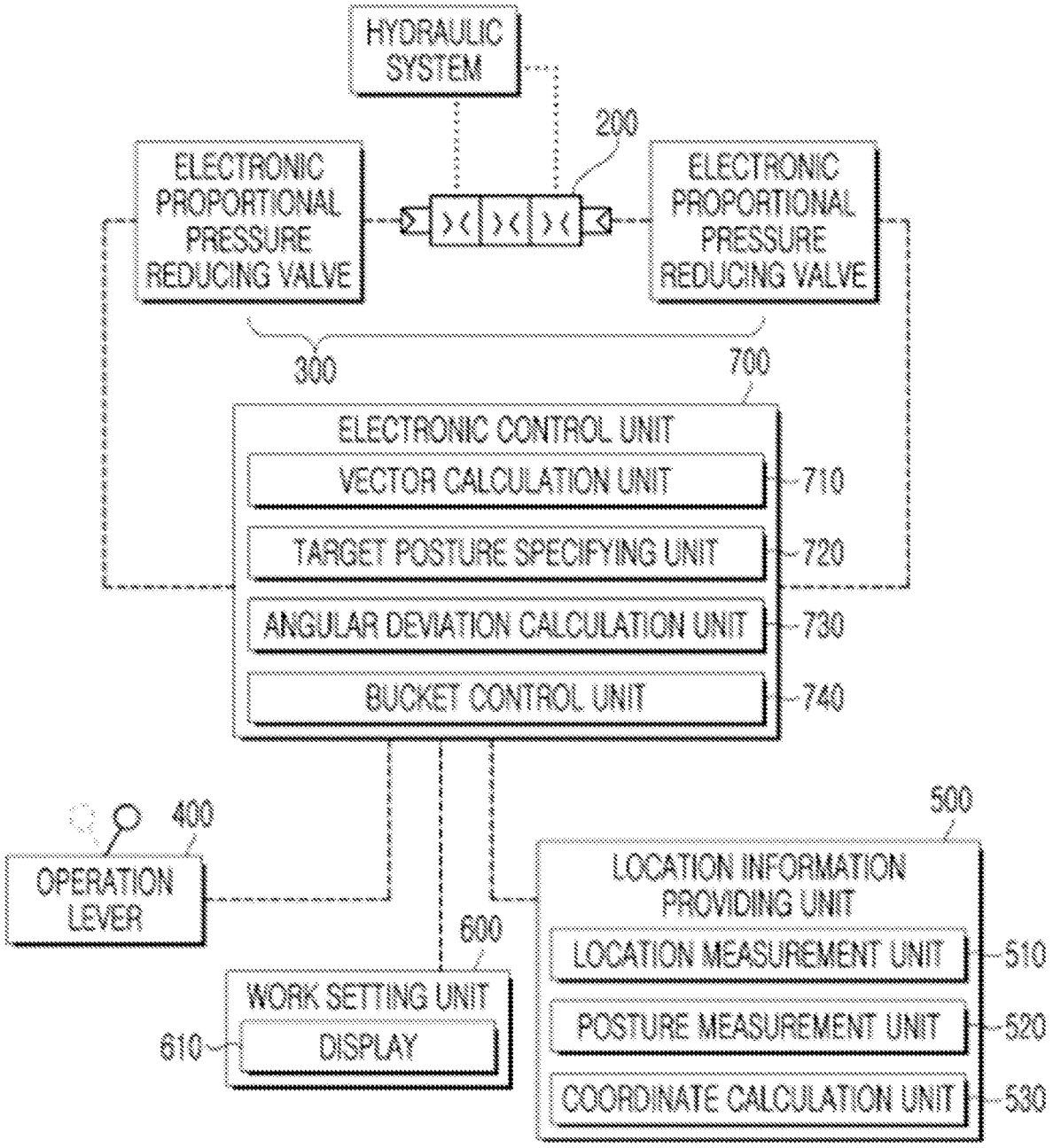
FIG. 4 is a block diagram illustrating a function of the construction equipment according to an embodiment of the present disclosure.

Referring to FIGS. 2 to 4, a construction equipment 100 according to an embodiment of the present disclosure comprises a lower traveling body 10, an upper rotating body 20 rotatably supported on the lower traveling body 10, and a work machine 30 supported by the upper rotating body 20. The work machine 30 comprises a boom 31, an arm 32, and a bucket 33 which operate by each hydraulic cylinder.

Additionally, the construction equipment 100 comprises a tilt rotator 70 comprising and/or consisting of a tilting actuator for the tilting of the bucket 33, and a rotating actuator 74 for the rotating operation of the bucket 33.

Specifically, the tilting actuator comprises a tilting pin 71 for supporting the bucket 33 to tilt, a damper 72 for coupling an attachment between the arm 32 and the bucket 33, and a first tilting cylinder 73*a* and a second tilting cylinder 73*b* for tilting the bucket 33. By driving the first tilting cylinder 73*a* and the second tilting cylinder 73*b*, the bucket 33 may be tilted centering around the tilting pin 71.

Also, the rotating actuator 74 is provided on the top of the bucket 33, and comprises a worm wheel, a worm engaged with the worm wheel, and a hydraulic motor for driving the worm. When the worm rotates according to the driving of the hydraulic motor, the worm wheel engaged with the worm also rotates, and thereby the bucket 33 fastened to the rotating actuator 74 also rotates.

The tilt rotator 70 and the bucket 33 are fastened in parallel, and thus the rotating axis of the tilt rotator 70 is identical to the rotating axis of the bucket 33.

Here, the first tilting cylinder 73*a* and the second tilting cylinder 73*b* may operate by the hydraulic cylinder, and the rotating actuator 74 may operate by the hydraulic motor which drives the worm and the worm wheel. However, the operating manners are not limited thereto, and various manners for operating the tilting and rotation with one hydraulic motor may be applied.

The construction equipment 100 according to an embodiment of the present disclosure comprises a control valve 200 for controlling a hydraulic cylinder and a hydraulic motor, an electronic proportional pressure reducing valve 300 for controlling spool of the control valve 200, an operation lever 400 for outputting an operation signal corresponding to an operation amount of a driver, a location information providing unit 500 for collecting and/or calculating location information and posture information of the work machine 30, a work setting unit 600 for setting and/or selecting a work area W of the work machine 30 and providing plane information of the work area W, and an electronic control unit 700 for outputting a control signal for the electronic proportional pressure reducing valve 300 according to a signal inputted from at least one of the operation lever 400, the work setting unit 600 and the location information providing unit 500.

The control valve 200 is a member for opening and closing a flow path by the spool which moves axially by receiving pressure. In other words, the control valve 200 serves a role of converting a supplying direction of the hydraulic oil supplied by a hydraulic pump which is a hydraulic source towards the hydraulic cylinder and hydraulic motor. The control valve 200 is connected to the hydraulic pump through a hydraulic pipe and induces the supplying of the hydraulic oil to the hydraulic cylinder and hydraulic motor from the hydraulic pump.

The electronic proportional pressure reducing valve 300 is an electronically operated valve, and comprises a solenoid unit for generating electromagnetic force and a valve unit used as a flow path of a fluid.

The electronic proportional pressure reducing valve 300 generates a hydraulic pressure in correspondence with an electric signal applied by the electronic control unit 700, and the generated hydraulic pressure is delivered from the electronic proportional pressure reducing valve 300 to the control valve 200. The hydraulic pressure from the electronic proportional pressure reducing valve 300 axially moves the spool within the control valve 200.

Specifically, the electronic proportional pressure reducing valve 300 variably adjusts a left tilting signal pressure supplied to the spool of the control valve 200 according to the electric signal input from the electronic control unit 700 when it is determined that the bucket 33 is in a left tilting control section by the electronic control unit 700. In this case, as the movement direction of the fluid is set so that the fluid can be supplied to the first tilting cylinder 73*a* which tilts the bucket 33 to the left, when the fluid is introduced, the tilt rotator 70 is tilted to the left as much as a prescribed angle, and the bucket 33 coupled with the tilt rotator 70 is also tilted as much as the same angle.

In addition, the electronic proportional pressure reducing valve 300 variably adjusts a right tilting signal pressure supplied to the spool of the control valve 200 according to the electric signal input from the electronic control unit 700 when it is determined that the bucket 33 is in a right tilting control section by the electronic control unit 700. In this case, as the movement direction of the fluid is set so that the fluid can be supplied to the second tilting cylinder 73*b* which tilts the bucket 33 to the right, when the fluid is introduced, the tilt rotator 70 is tilted to the right as much as a prescribed angle, and the bucket 33 coupled with the tilt rotator 70 and the clamper 72 is also tilted as much as the same angle.

The operation lever 400 may be a hydraulic joystick or an electric joystick, and preferably may be an electric joystick which generates an electric signal in proportional to the operation amount of the driver to provide the same to the electronic control unit 700.

The location information providing unit 500 may comprise a location measurement unit 510 for receiving a signal transmitted from a global positioning system (GPS) satellite to measure location information of the construction equipment 100, a posture measurement unit 520 for measuring posture information of the construction equipment 100 and the posture information of the boom 31, the arm 32, and the bucket 33, and a coordinate calculation unit 530 for calculating coordinates of each section of the construction equipment 100 from the location information and posture information measured from the location measurement unit 510 and the posture measurement unit 520 based on size information of the construction equipment 100.

The location measurement unit 510 may comprise a receiver capable of receiving a signal transmitted from the GPS satellite, and measure location information of the construction equipment 100 from the received signal.

The posture measurement unit 520 measures the location and/or posture of the boom 31, the arm 32 and the bucket 33, and a body gradient, etc. of the construction equipment 100 by using a plurality of inertial measurement units (IMU), an angle sensors, etc. For example, an inertial measurement unit may be arranged in each of the upper rotating body 20, the boom 31, the arm 32, the bucket 33, and the tilt rotator 70. The posture information such as an acceleration velocity of the upper rotating body 20, the boom 31, the arm 32, the bucket 33 and the tilt rotator 70 in the front and rear direction, the left and right direction, and the up and down direction, and an angular velocity of the upper rotating body 20, the boom 31, the arm 32, the bucket 33 and the tilt rotator 70 around the front and rear direction, the left and right direction, and the up and down direction may be measured. Also, the posture measurement unit 520 may measure posture information when the bucket 33 contacts the work area W.

The coordinate calculation unit 530 calculates at least one x, y, z coordinates of the upper rotating body 20, the boom 31, the arm 32, the bucket 33 and the tilt rotator 70 from the location information and posture information measured from the location measurement unit 510 and the posture measurement unit 520 based on size information of the construction equipment 100 inputted in advance.

Also, the location information providing unit 500 may further comprise a mapping unit for mapping geographic information around the work location and construction information for the work location on the calculated coordinate. The mapping unit adjusts and maps the location and/or posture of each work machine 30 measured from the posture measurement unit 520 and the body gradient, etc. of the construction equipment 100 according to each axis calculated in the coordinate calculation unit 530.

The work setting unit 600 may set and/or select the work area W of the work machine 30, and provide plane information of the work area set and/or selected. Additionally, the work setting unit 600 may comprise work mode functions which can be variously set and/or selected as needed by the driver such as bucket posture control mode, work area limit mode, swing position control mode, etc.

The work setting unit 600 may display, on a display 610 screen, at least one of the geographic information and location information provided from the location information providing unit 500, the posture information of the construction equipment 100, and the plane information of the work area W set in the work setting unit 600, according to the setting and/or selection of the work area W and/or the work mode.

In other words, the driver may set and/or select the work area W and/or work mode on the display 610 screen, and accordingly easily work by using the displayed information. In this case, the work area W means a design surface that the driver aims to work. For example, the driver may input an inclination value through the display 610 which provides a touchscreen function to generate the work area W.

The electronic control unit 700 specifies the posture of the bucket 33 based on the operation signal of the operation lever 400, the geographic information provided from the location information providing unit 500, the location information and posture information of the work machine 30, and plane information of the work area W inputted from the work setting unit 600, and accordingly controls the posture of the bucket 33.

Specifically, the electronic control unit 700 comprises a vector calculation unit 710, a target posture specifying unit 720, an angular deviation calculation unit 730, and a bucket control unit 740.

The vector calculation unit 710 calculates a movement direction vector of the bucket 33 using the location information measured from the location measurement unit 510 and the posture measurement unit 520.

Specifically, the vector calculation unit 710 calculates the movement direction vector $\vec{A}$ of the actual bucket 33 from information such as accelerated velocity, angular velocity, etc. of the upper rotating body 20, the boom 31, the arm 32, the bucket 33, and the tilt rotator 70. Meanwhile, when the movement direction vector $\vec{A}$ of the bucket 33 is calculated based on the tip of bucket 33, the direction of the vector $\vec{A}$ could be unstable by the shaking of the bucket 33. Accordingly, it is preferable to calculate the movement direction vector $\vec{A}$ of the bucket 33 based on the front end of the arm 32, which relatively shakes less.

Furthermore, when the driver sets the target work area W on the work setting unit 600, the vector calculation unit 710 calculates a normal vector $\vec{N}$ of the work area W in consideration of the plane information such as angle, etc. of the work area W provided from the work setting unit 600.

Also, the vector calculation unit 710 may calculate a width direction vector $\vec{T}$ of the bucket 33 tip from the movement direction vector $\vec{A}$ of the bucket 33 and the normal vector $\vec{N}$ of the work area W calculated in the above.

The target posture specifying unit 720 specifies the target posture of the bucket 33 when the bucket 33 tip contacts the work area W based on the normal vector $\vec{N}$ of the work area W provided from the vector calculation unit 710 and an orthogonal projection of the bucket 33 tip. Here, the bucket 33 tip contacting the work area W includes not only the case where the bucket 33 tip simply contacts the work area W, but also the case where the rotating axis of the bucket 33 is aligned in the normal vector $\vec{N}$ of the work area W.

The angular deviation calculation unit 730 compares the target posture of the bucket 33 provided from the target posture specifying unit 720 with the posture of the current bucket 33 to calculate the deviation of the tilting angle, rotating angle and rotational angle of the bucket 33.

The bucket control unit 740 controls the posture of the bucket 33 based on the information provided from the angular deviation calculation unit 730.

Figure 5:
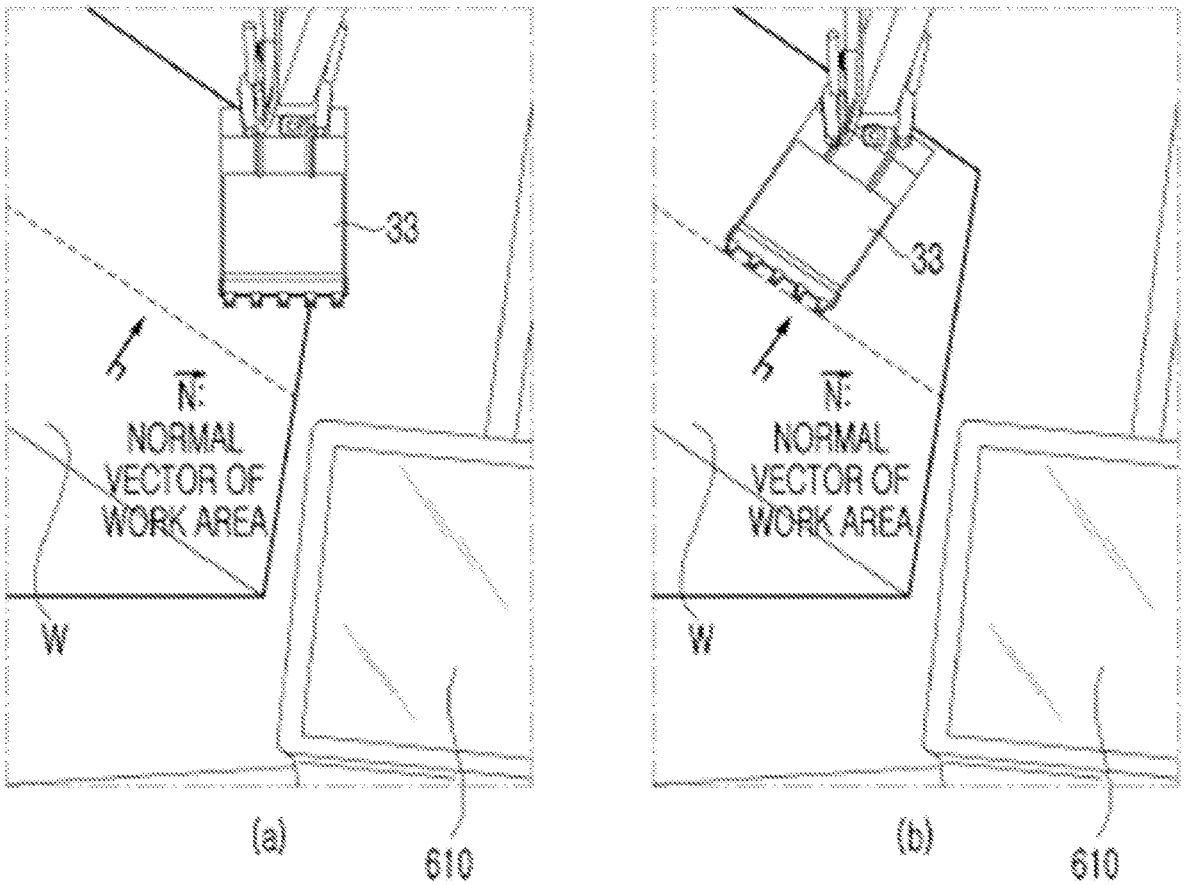
FIG. 5 is a schematic diagram illustrating an alignment for a work area of a bucket according to an embodiment of the present disclosure.
Figure 6:
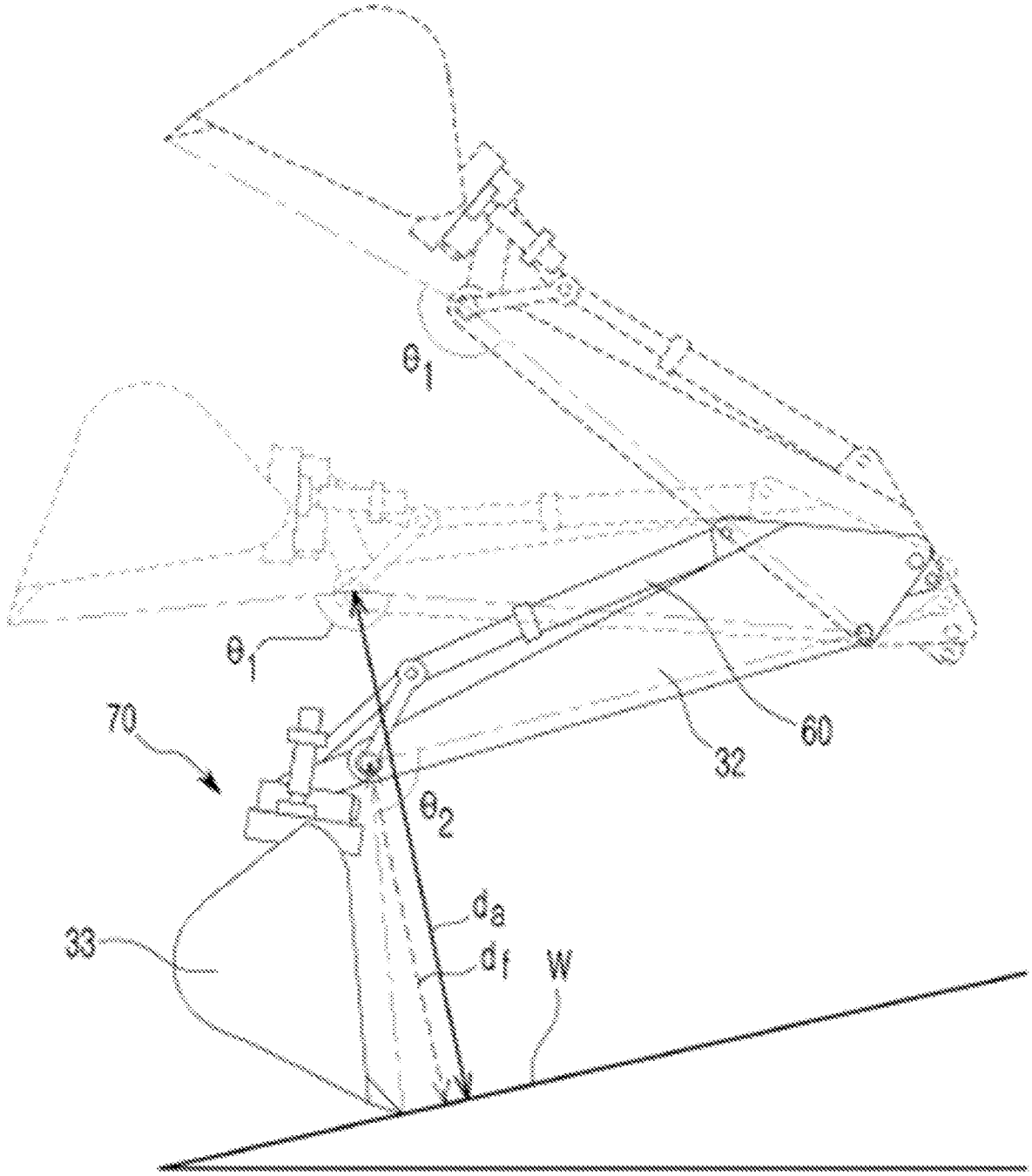
FIGS. 6 and 7 are schematic diagrams illustrating a posture control of the bucket according to an embodiment of the present disclosure.

Referring to FIGS. 5 and 6, the bucket 33 of the construction equipment 100 according to an embodiment of the present disclosure is controlled in the following manner.

First, the driver selects ON of the posture control mode of the bucket 33 on the display 610 screen of the work setting unit 600. However, the present disclosure is not limited thereto, and a switch for inputting ON and OFF of the posture control mode of the bucket 33 may be arranged on the operation lever 400.

Next, the target work area W is set. For example, the driver may form an inclined surface having an inclined angle of 30° as the work area W through the display 610.

The location information and posture information of the work machine 30 of the location information providing unit 500, and the plane information of the work area W set in the work setting unit 600 are provided to the electronic control unit 700.

The vector calculation unit 710 forms the normal vector $\vec{N}$ of the work area W with the plane information of the work area W provided. For example, when information on the inclined surface having an inclined angle of 30° is delivered to the vector calculation unit 710, the vector calculation unit 710 forms the normal vector $\vec{N}$ for the inclined surface and provides the same to the target posture specifying unit 720.

The target posture specifying unit 720 specifies the target posture of the bucket 33 when the bucket 33 tip contacts the work area W from the normal vector $\vec{N}$ of the work area W provided from the vector calculation unit 710. For example, the target posture specifying unit 720 specifies the tilt angle, rotating angle and rotational angle of the bucket 33 when the bucket 33 tip contacts the inclined surface having an inclined angle of 30°.

Specifically, the angular deviation calculation unit 730 calculates the angular deviation between the target posture of the bucket 33 and the current posture of the bucket 33 based on the orthogonal projection of the bucket 33 tip for the work area W. However, the calculation method is not limited thereto, and the angular deviation calculation unit 730 may calculate angular deviation based on the orthogonal projection of the bucket 33 tip with respect to the plane vertical to gravity.

Specifically, the angular deviation calculation unit 730 calculates angular deviation between the tilting angle of the target posture of the bucket 33 and the tilting angle of the current posture of the bucket 33, based on the various location information and posture information of the location information providing unit 500 and the target posture of the bucket 33 provided from the target posture specifying unit 720, and provides the same to the bucket control unit 740.

Also, the angular deviation calculation unit 730 calculates angular deviation between the rotating angle of the target posture of the bucket 33 and the rotating angle of the current posture of the bucket 33, based on various location information and posture information of the location information providing unit 500, and the target posture of the bucket 33 provided from the target posture specifying unit 720, and provides the same to the bucket control unit 740.

Furthermore, the angular deviation calculation unit 730 calculates angular deviation θ between the rotational angle θ2 of the target posture of the bucket 33 and the rotational angle θ1 of the current posture of the bucket 33, based on various location information and posture information of the location information providing unit 500 and the target posture of the bucket 33 provided from the target posture specifying unit 720, and provides the same to the bucket control unit 740.

For example, referring to FIG. 6, the rotational angle of the bucket 33 may be an angle formed by a joint of the arm 32, a joint of the bucket 33, and a tip of the bucket 33. In this case, the angular deviation calculation unit 730 calculates a difference θ1−θ2 between the rotational angle θ1 of the current posture of the bucket 33 and the rotational angle θ2 of the target posture of the bucket 33, and provides the same to the bucket control unit 740.

When the driver operates the boom 31 and arm 32 for the excavation operation of the work area W, and an operation signal of the operation lever 400 is inputted to the electronic control unit 700, the electronic control unit 700 determines whether the bucket 33 is close to the set work area W. Specifically, the electronic control unit 700 calculates the distance between the bucket 33 and the set work area W, and then compares the calculated distance with a predetermined value to initiate the posture control of the bucket 33 when the calculated distance is smaller than the predetermined value.

Meanwhile, when calculating the distance between the bucket 33 and the set work area W, in case the distance between the current bucket 33 tip and the work area W is measured, the measured distance may be unstable by the shaking of the bucket 33 tip. Accordingly, it is preferable to determine whether to initiate the posture control of the bucket 33 based on the front end of the arm 32 or the joint of the bucket 33 coupled to the front end of the arm 33, which relatively shakes less.

Figure 7:
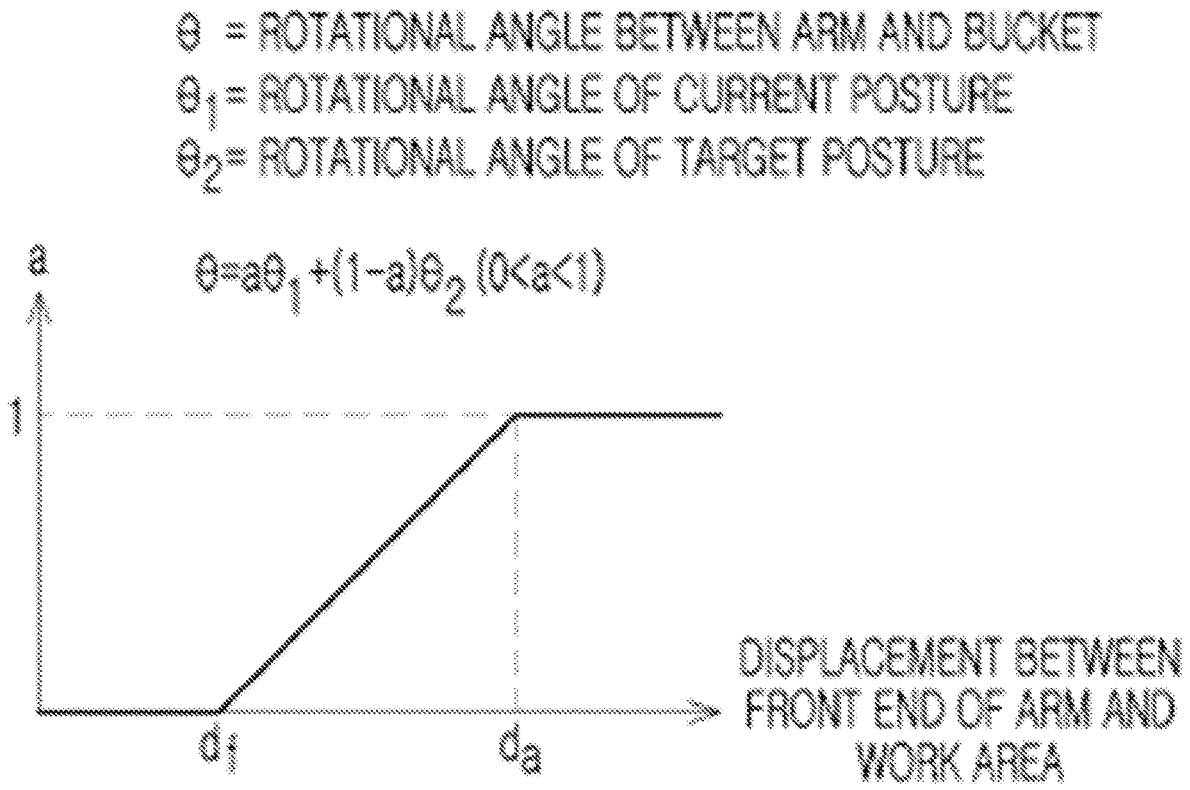

Specifically, referring to FIGS. 6 and 7, whether to initiate the posture control of the bucket 33 may be determined based on the displacement between the front end of the arm 32 and the work area W. The bucket control unit 740 does not control the posture of the bucket 33 when it is determined that the displacement between the front end of the arm 32 and the work area W is greater than a predetermined value $d_c$. Accordingly, the bucket 33 maintains the initial rotational angle θ1 and approaches the work area W.

Afterwards, when it is determined that the displacement between the front end of the arm 32 and the work area W is smaller than the predetermined value $d_a$, the bucket control unit 740 converts the angular deviation θ1-θ2 calculated from the angular deviation calculation unit 730 into an electric signal, and transmits the same to the electronic proportional pressure reducing valve 300.

The bucket control unit 740 converts information on the tilting angular deviation calculated from the angular deviation calculation unit 730 into an electric signal and transmits the same to the electronic proportional pressure reducing valve 300, and the electronic proportional pressure reducing valve 300 generates hydraulic pressure corresponding to the tilting angular deviation and supplies the fluid to the tilting actuator so that the tilting angular deviation can be reduced.

In addition, the bucket control unit 740 converts information on the rotating angular deviation calculated from the angular deviation calculation unit 730 into an electric signal, and transmits the same to the electronic proportional pressure reducing valve 300, and the electronic proportional pressure reducing valve 300 generates hydraulic pressure corresponding to the rotating angular deviation and supplies the fluid to the rotating actuator 74 so that the rotating angular deviation can be reduced.

Also, the bucket control unit 740 converts information on the rotating angular deviation calculated from the angular deviation calculation unit 730 into an electric signal, and transmits the same to the electronic proportional pressure reducing valve 300, and the electronic proportional pressure reducing valve 300 generates hydraulic pressure corresponding to the rotating angular deviation and supplies the fluid to the bucket cylinder 60 so that the rotating angular deviation can be reduced.

Preferably, the bucket control unit 740 may control the rotational angle θ between the arm 32 and the bucket 33 to reach the rotational angle θ2 of the target posture of the bucket 33 as the front end of the arm 32 gets closer to the work area W.

Specifically, as illustrated in FIG. 7, the rotational angle θ between the arm 32 and the bucket 33 may be $\theta = a \cdot \theta_1 + (1-a) \cdot \theta_2$, which is a linear relationship between the rotational angle θ1 of the current posture and the rotational angle θ2 of the target posture. In this case, when the displacement between the front end of the arm 32 and the work area W is a predetermined value $d_a$, a may be set as 1. Additionally, when the bucket 33 tip contacts the work area, that is, the displacement between the front end of the arm 32 and the work area W is $d_f$, a may be set as 0.

In this case, when the displacement between the front end of the arm 32 and the work area W is smaller than the predetermined value $d_a$, the rotational angle θ1 between the arm 32 and the bucket 33 becomes smaller, and when the bucket 33 tip contacts the work area W, the angle between the arm 32 and the bucket 33 meets the rotating angle θ2.

Meanwhile, as illustrated in FIG. 7, a may be linearly set according to the displacement between the front end of the arm 32 and the work area W, but is not limited thereto.

When referring to FIG. 5, when the bucket 33 approaches the work area W, the posture of the bucket 33 is controlled so that the tilting angle, the rotating angle, and the rotational angle of the bucket 33 are adjusted, and thus the bucket 33 tip is located to contact the work area W as illustrated in FIG. 5(*b*).

Preferably, even when the posture control function of the bucket 33 is ON and thus the posture of the bucket 33 is automatically aligned with respect to the work area W, when the rotational angle, rotating angle, tilting angle, etc. of the bucket 33 are operated in another direction by the driver, the bucket 33 tip may be aligned in the operated direction. Afterwards, when the driver selects ON of the posture control of the bucket 33 on the display 610 screen or presses the ON switch of the tilt automatic control arranged in the operation lever 400, the posture of the bucket 33 may be controlled so that the bucket 33 tip contacts the work area W again.

Preferably, when the rotating operation signal of the input bucket 33 lasts longer than a predetermined time while the posture of the bucket 33 is automatically aligned with respect to the work area W, the electronic control unit 700 may align the rotating axis of the bucket 33 in the normal vector $\vec{N}$.

Furthermore, when the rotating operation signal of the input bucket 33 lasts shorter than the predetermined time, the electronic control unit 700 simply determines the same as an intention to convert the direction of the bucket 33 tip, and controls the rotating actuator 74 so as to correspond to the operation signal to rotate the bucket 33, and also controls the tilting actuator and bucket cylinder 60 so that the bucket 33 tip does not invade the work area W.

Meanwhile, when the driver rotates an upper frame or operate the arm 32 to excavate the work area W after the bucket 33 tip is aligned to contact the work area W as above, the angle of the bucket 33 with respect to the inclined surface may be changed. Accordingly, since the driver has to adjust the angle of the bucket 33 relying on his senses after checking the degree of inclination of the work area W formed, the operation time would be longer, and the work area W would have ununiform inclined surfaces.

Therefore, the electronic control unit 700 according to an embodiment of the present disclosure controls the posture of the bucket 33 so that the movement direction vector $\vec{A}$ of the bucket 33 contacts the normal vector $\vec{N}$ of the work area W.

To this end, the electronic control unit 700 controls the movement direction of the bucket 33 so that an inner product value of the movement direction vector $\vec{A}$ of the bucket 33 for the normal vector $\vec{N}$ of the work area W is 0.

In this case, when the driver rotates the upper frame 20 or operates the arm 32 to excavate the inclined surface, even when the driver does not adjust the tilting or rotating of the bucket 33 arbitrarily, since the bucket 33 tip contacts the work area W, it is possible to remarkably shorten the work time during the excavation work of forming the inclined surface, and provide a uniform inclined surface.

When the movement direction vector $\vec{A}$ of the bucket 33 is calculated based on the bucket 33 tip, errors may be generated by the shaking of the bucket 33. Accordingly, it is preferable to calculate the movement direction vector $\vec{A}$ of the bucket 33 based on the front end of the arm 32, which shakes relatively less.

Meanwhile, when the width direction of the bucket 33 tip is located to be vertical to the movement direction of the bucket 33, the work area becomes broader, and thereby the work may be performed more efficiently. Meanwhile, the driver's work of adjusting the width of the bucket 33 tip to be vertical to the movement direction of the bucket 33 while moving the bucket 33 along the inclined surface in order to excavate the inclined surface requires higher experienced skills.

Accordingly, when a beginner performs the work, the width of the bucket 33 tip is located to be inclined with respect to the movement direction, thereby reducing the work area.

Figure 8:
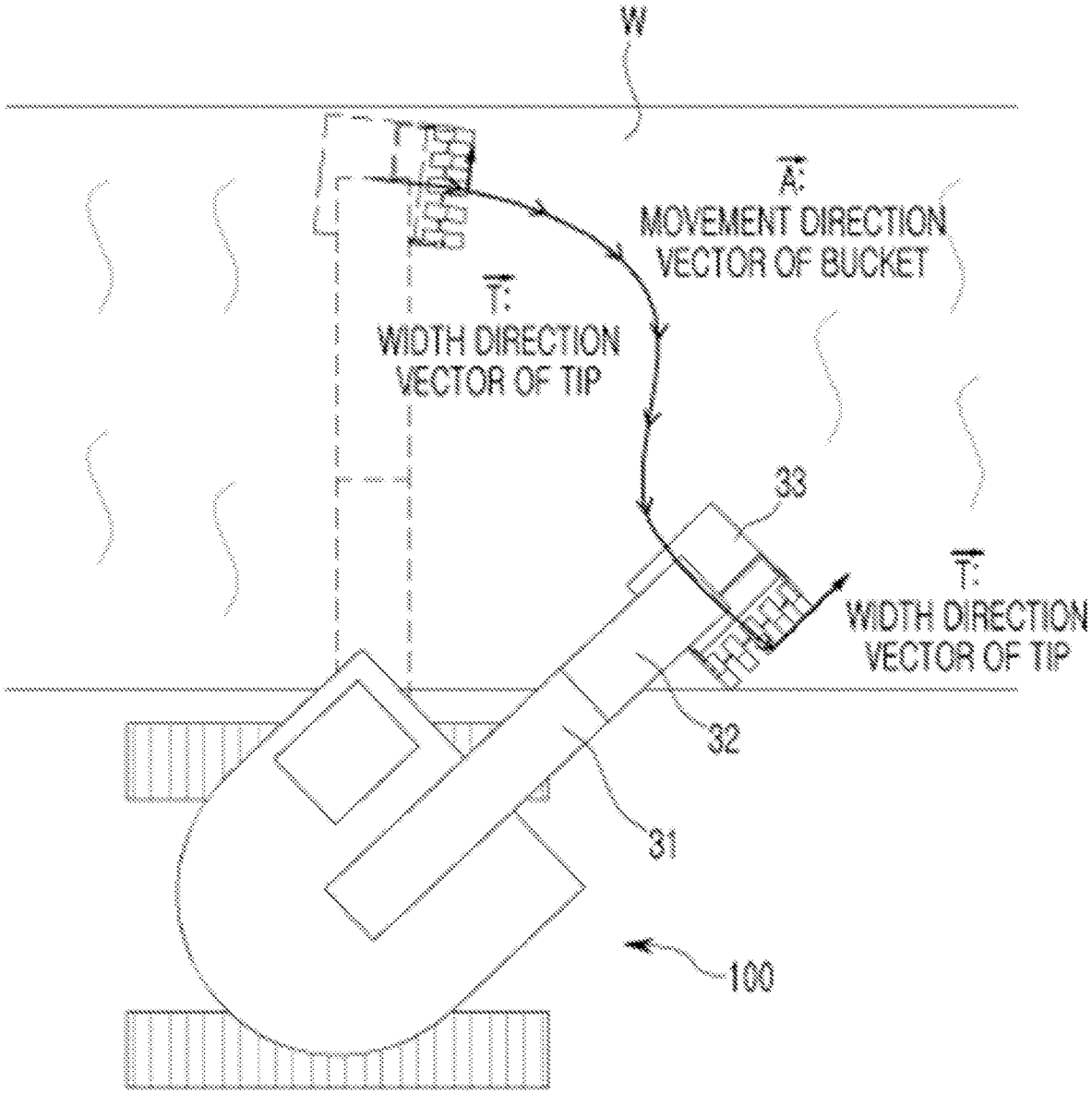
FIG. 8 is a schematic diagram illustrating a posture control of the bucket when rotating the construction equipment according to an embodiment of the present disclosure.

Therefore, as illustrated in FIG. 8, the rotating angle of the bucket 33 is controlled so that the width direction vector $\vec{T}$ of the bucket 33 tip can be vertical to the movement direction vector $\vec{A}$ of the bucket 33 in the construction equipment 100 according to an embodiment of the present disclosure.

To this end, the electronic control unit 700 controls the rotating angle of the bucket 33 so that an outer product direction of the movement direction vector $\vec{A}$ of the bucket 33 with respect to the normal vector $\vec{N}$ of the work area W can become the width direction of the bucket 33 tip based on the movement direction vector $\vec{A}$ of the bucket 33 and the normal vector $\vec{N}$ of the set work area W.

In other words, the movement direction vector $\vec{A}$ of the bucket 33, the normal vector $\vec{N}$ of the work area W, and the width direction vector $\vec{T}$ of the bucket 33 tip are controlled to be vertical to each other.

As such, according to the construction equipment 100 according to an embodiment of the present disclosure, even when the driver does not adjust the rotating angle of the bucket 33 arbitrarily according to the movement direction of the bucket 33, since the width direction of the bucket 33 tip is located to be vertical to the movement direction of the bucket 33, it is possible to maximize the work area and perform the work more efficiently.

The foregoing description of the present disclosure has been presented for illustrative purposes, and it is apparent to a person having ordinary skill in the art that the present disclosure can be easily modified into other detailed forms without changing the technical idea or essential features of the present disclosure. Therefore, it should be understood that the forgoing embodiments are by way of example only, and are not intended to limit the present disclosure. For example, each component which has been described as a unitary part can be implemented as distributed parts. Likewise, each component which has been described as distributed parts can also be implemented as a combined part.

The scope of the present disclosure is presented by the accompanying claims, and it should be understood that all changes or modifications derived from the definitions and scopes of the claims and their equivalents fall within the scope of the present disclosure.

100: construction equipment
200: control valve
300: electronic proportional pressure reducing valve
400: operation lever
500: location information providing unit
600: work setting unit
700: electronic control unit

What is claimed is:

1. A construction equipment, comprising:

a lower traveling body;

an upper rotating body rotatably supported on the lower traveling body;

a work machine which comprises a boom rotatable with respect to the upper rotating body, an arm rotatable with respect to the boom, a bucket rotatable with respect to the arm, and a tilt rotator comprising a tilting actuator for supporting the bucket to tilt with respect to the arm, and a rotating actuator for supporting the bucket to rotate with respect to the arm;

an operation lever for outputting an operation signal corresponding to an operation amount of a driver;

a location information providing unit for providing location information and posture information of the work machine;

a work setting unit for setting a work area of the work machine, and providing plane information of the work area; and an electronic control unit for controlling the work machine according to a signal inputted from at least one of the operation lever, the work setting unit and the location information providing unit, wherein the electronic control unit controls the posture of the bucket so that the tip of the bucket contacts the work area, wherein the electronic control unit calculates a normal vector of the work area in consideration of plane information of the work area, wherein the electronic control unit calculates a movement direction vector of the bucket in consideration of the location information and posture information of the work machine, wherein the electronic control unit calculates a width direction vector of the bucket tip by outer products of the movement direction vector of the bucket and the normal vector of the work area.

2. The construction equipment according to claim 1, wherein the electronic control unit specifies a target posture of the bucket when the tip of the bucket contacts the work area based on the normal vector and an orthogonal projection of the bucket tip.

3. The construction equipment according to claim 2, wherein the electronic control unit compares a current posture of the bucket with a target posture of the bucket to calculate angular deviation of at least one of a tilting angle, a rotating angle and a rotational angle of the bucket.

4. The construction equipment according to claim 3, wherein the electronic control unit generates a hydraulic pressure corresponding to the angular deviation, and supplies the same to at least one of the tilting actuator, the rotating actuator, and a bucket cylinder.

5. The construction equipment according to claim 3, wherein the electronic control unit calculates the displacement between the front end of the arm and the work area when an operation signal of the operation lever is inputted, and controls a posture of the bucket when the displacement is smaller than a predetermined reference value.

6. The construction equipment according to claim 5, wherein the electronic control unit controls the angular deviation to be reduced as the front end of the arm gets closer to the work area.

7. The construction equipment according to claim 1, wherein the movement direction vector of the bucket is configured to be calculated based on the front end of the arm.

8. The construction equipment according to claim 1, wherein the movement direction vector of the bucket, the normal vector of the work area, and the width direction vector of the bucket tip are vertical to each other.

9. The construction equipment according to claim 1, wherein the location information providing unit comprises at least one of a location measurement unit for measuring location information of the construction equipment, a posture measurement unit for measuring posture information of the construction equipment and posture information of each work machine, and a coordinate calculation unit for calculating coordinates based on the location information and posture information measured from the location measurement unit and the posture measurement unit.

10. The construction equipment according to claim 1, wherein the operation lever generates an electric signal in proportional to the operation amount of the driver as an electric joystick to provide the same to the electronic control device.

11. The construction equipment according to claim 1, wherein the electronic control unit aligns a rotating axis of the bucket, the rotating axis aligned with the calculated normal vector of the work area, to be vertical to the work area when the rotating operation signal of the bucket lasts longer than a predetermined reference value, controls the rotating actuator to correspond to the operation signal to rotate the bucket when the rotating operation signal of the bucket lasts shorter than the predetermined reference value, and controls the tilting actuator and the bucket cylinder so that the tip of the bucket does not invade the work area.

* * * * *